United States Patent [19]

Witherspoon

[11] 3,949,827

[45] Apr. 13, 1976

[54] ACOUSTICAL PANEL ASSEMBLY

[75] Inventor: Charles R. Witherspoon, Newark, Ohio

[73] Assignee: Owens-Corning Fiberglas Corporation, Toledo, Ohio

[22] Filed: Apr. 24, 1975

[21] Appl. No.: 571,121

[52] U.S. Cl. ..... 181/33 GB; 52/239; 52/241; 181/33 G

[51] Int. Cl.[2] ..... G01K 11/04; E04B 1/99

[58] Field of Search ..... 52/239, 241; 160/135, 351; 181/33 G, 33 GA, 33 GB, 33 GE

[56] References Cited

UNITED STATES PATENTS

| | | | |
|---|---|---|---|
| 3,058,441 | 10/1962 | Hanson et al. | 181/33 G |
| 3,497,029 | 2/1970 | Stark | 181/33 GB |
| 3,695,330 | 10/1972 | Hasbrouck | 160/135 |
| 3,713,508 | 1/1973 | Eckel | 181/33 GB |
| 3,768,222 | 10/1973 | Birum | 52/239 |

*Primary Examiner*—Lawrence R. Franklin
*Attorney, Agent, or Firm*—John W. Overman; Paul J. Rose

[57] ABSTRACT

An acoustical panel assembly having improved structural, decorative and acoustical properties is disclosed. The panel assembly includes a perimeter frame. A thin septum member is supported in the center of the frame. A fibrous glass layer is positioned adjacent each side of the septum member. A molded, semi-rigid, fibrous glass diffuser member is positioned adjacent each of the fibrous glass layers. The assembly includes means for joining adjacent panel assemblies and, in one embodiment, an outer decorative fabric layer is positioned adjacent each of the outer surfaces of the diffuser members.

21 Claims, 8 Drawing Figures

ACOUSTICAL PANEL ASSEMBLY

BACKGROUND OF THE INVENTION

In many modern office buildings, permanent walls, of the non-load bearing type, are not desirable to define offices or secretarial work areas. Many modern day buildings had been designed utilizing open area work spaces. However, from a psychological and from a privacy standpoint, it is often necessary to divide some of the work areas into individual spaces and the use of partition walls and screening between such work areas or work stations is well known in the art.

Another reason for using removable and transportable screens or panel assemblies in work areas is that the work areas may be redesigned and modified as the use for the space changes. This avoids costly remodeling projects.

Some of the problems encountered in using prior art screens or panel assemblies were that their structural design often lacked flexibility and stability. In addition, many prior art screens or panel assemblies did not provide sufficient acoustical properties to insure speech privacy. Lastly, many of the prior art screens or panel assemblies were aesthetically unappealing.

SUMMARY OF THE INVENTION

The present invention relates to an improved acoustical panel assembly having improved structural integrity, sufficient acoustical properties to insure speech privacy and improved decorative characteristics. A plurality of panel assemblies, according to the present invention, are often joined together to form a partition wall. Each of the panel assemblies includes a perimeter frame which supports a thin septum member. A fibrous glass layer is positioned adjacent each side of the septum member and a semi-rigid fibrous glass diffuser member is positioned on the opposite side adjacent each of the fibrous glass layers. Means are provided for joining adjacent ones of the panel assemblies together to form the overall divider wall structure. In a preferred embodiment, an outer decorative fabric layer is positioned adjacent the outer surfaces of the diffuser members thereby forming an attractive assembly which gives a furniture appearance as opposed to a temporary partition appearance.

DESCRIPTION OF THE PREFERRED EMBODIMENTS

Figure 1:
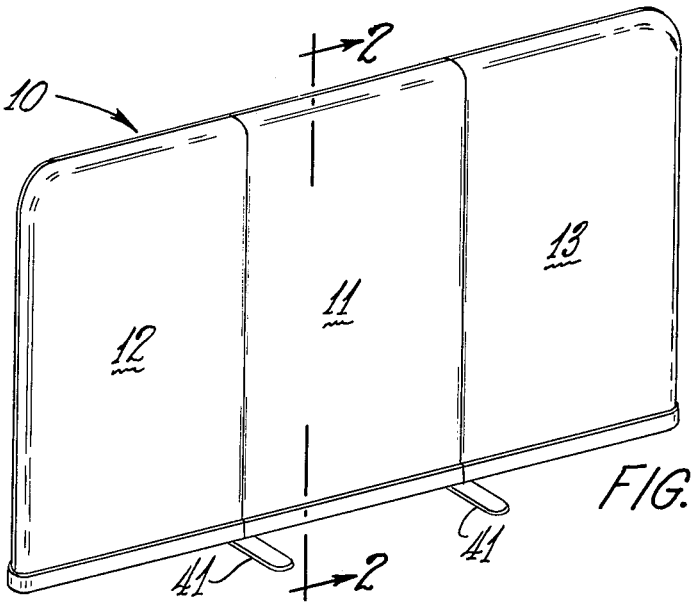
FIG. 1 is a perspective view showing three acoustical panel assemblies, according to the present invention, joined together to define an overall partition wall structure.

Referring to FIG. 1, an acoustical panel assembly partition wall, according to the present invention, is generally indicated by the reference number 10. The acoustical panel assembly partition wall 10, in the FIG. 1 embodiment, includes a center acoustical panel 11 and two adjacent end acoustical panel assemblies 12 and 13. In this particular embodiment, the end panels 12 and 13 and the center panel assembly 11 form an overall longitudinally extending decorative wall assembly when they are joined together, as shown in FIG. 1. It should be noted that various combinations of acoustical panel assemblies 10 may be placed together to define partition walls of varying lengths and configurations. The construction of the acoustical panel assemblies 11, 12 and 13 are similar and will be explained below with reference to the center panel assembly 11.

Figure 2:
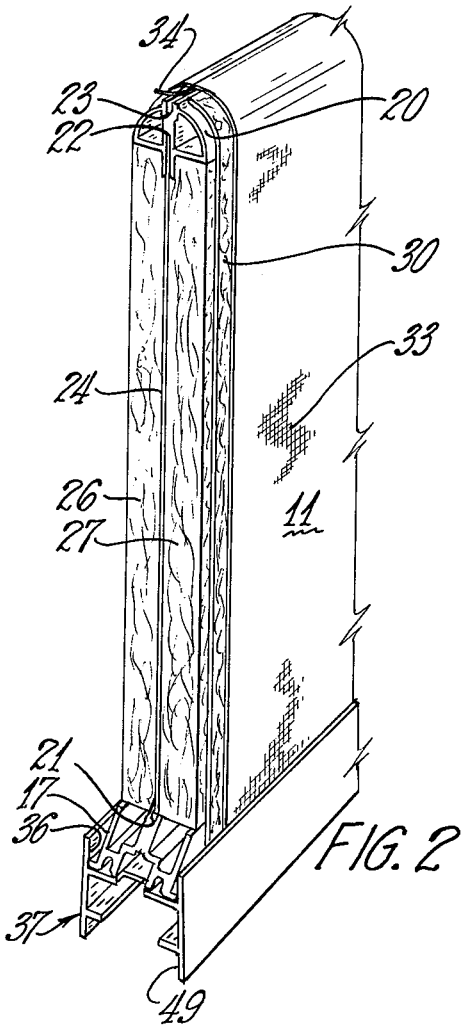
FIG. 2 is a diagrammatic sectional view, taken along the line 2—2 of FIG. 1.
Figure 4:
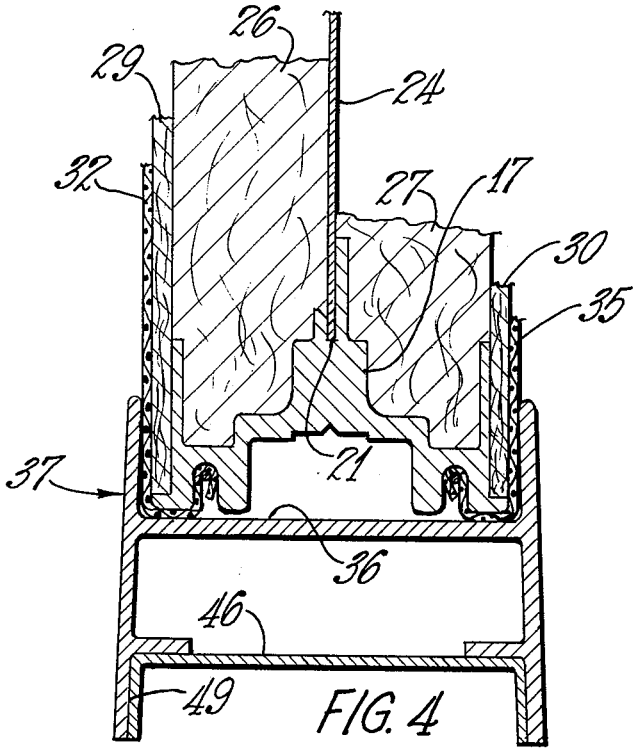
FIG. 4 is an enlarged sectional view, taken along the line 4—4 of FIG. 1.
Figure 5:
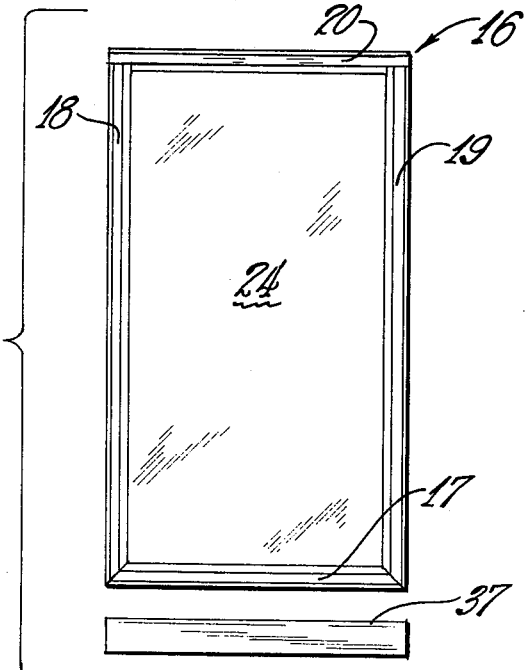
FIG. 5 is a diagrammatic exploded view showing the frame members of a panel assembly constructed according to the present invention and further showing a septum member and a bottom kick panel member.

Referring to FIG. 5, the panel assembly 11 includes a perimeter wall frame 16. The wall frame 16, in this embodiment, includes a bottom frame member 17, side frame members 18 and 19 and top frame member 20. The bottom frame member 17 and the side frame members 18 and 19 are constructed of aluminum extrusions of the configuration shown in FIG. 4. The frame members 17, 18 and 19 include a central longitudinally extending groove 21. Other types of material may be utilized for the members 17, 18 and 19, for examples, steel, wood, vinyl or other semi-rigid plastics. In this embodiment, the top frame member 20 is constructed of a vinyl material and includes a longitudinally extending bottom groove 22 which joins and is complementary with the perimeter groove 21 defined by the frame members 17, 18 and 19. The configuration of the top member 20 is shown in FIG. 2. The top frame member 20 also includes an outer longitudinally extending groove 23 along its upper surface. While the top frame member 20 is constructed of vinyl, in this embodiment, it may be constructed of other types of material, for examples, wood, aluminum, steel and other rigid plastics. The top frame members allow adjacent layers to be attached directly to such members to give a structurally integral panel together with a decorative outer appearance. It is noted that in the present embodiment, the outer side members of the end acoustical panel assemblies 12 and 13 are of essentially the same configuration as the top frame member 20.

In the initial construction of, for example, the center acoustical panel assembly 11, the bottom frame member 17 and the side frame members 18 and 19 are welded together. A septum member 24 is then positioned in the grooves 21 defined by the frame members 17, 18 and 19. The top frame member 20 is positioned with its groove 22 receiving the upper edge of the septum member 24 such that the wall frame 16 is completed. The wall frame 16 and the septum member 24 forms an integral structural skeleton which retards racking, which was one of the problems often found in prior art wall panels.

The septum member 24, in this embodiment, is an aluminum sheet 0.039 inch in thickness. It has been found that the septum member 24 reduces the transmission of sound waves through the acoustical panel assembly 10. Other materials may also be used to construct the septum, for examples, steel or pressboard.

The septum member 24 must be of a sufficient thickness so that a vibration condition will not occur. It has been found that an aluminum or steel septum member of a thickness between 0.030 and 0.050 inch provides a preferable range.

After corner caps are placed on the corners of the panel assembly 11 and on the curvilinear corners of the end acoustical panel assemblies 12 and 13, fibrous glass layers 26 and 27 are positioned on either side of the respective septum members 24 and are received by grooves defined by the wall frame 16, as shown in FIG. 4. Each fibrous glass layer 26 and 27 has a thickness between one-half inch and two inches. In the present embodiment, each fibrous glass layer 26 and 27 is one inch thick. The density of the material is preferably between three and six pounds a cubic foot. For example, the fibrous glass layers 26 and 27 may be constructed of Owens-Corning Fiberglas 700 Series Industrial Insulation. This product is a uniformly textured product of fine fibrous glass fibers bonded with a thermosetting resin.

Next, fibrous glass diffuser layers 29 and 30 are positioned adjacent the fibrous glass layers 26 and 27, respectively. The fibrous glass diffuser layers 29 and 30, in the present embodiment, comprise molded relatively high density fibrous glass board having a density between 12 and 25 pounds per cubic foot. For example, Fiberglas Glastrate board, manufactured by Owens-Corning Fiberglas, may be utilized for the diffuser layers 29 and 30. This product is a molded, flat, high density board having a density of approximately eighteen pounds per cubic foot. It has been found that this type of material transmits sound waves through the layers 29 and 30 where they may be acoustically absorbed by the fibrous glass layers 26 and 27. While some of the sound waves are reflected into the space, it has been found that the combination of the diffuser layers 29 and 30, the fibrous glass layers 26 and 27 and the central septum member 24 reduce the transmission of sound waves through the overall acoustical panel assembly 10. The molded diffuser layers 29 and 30 also present a smooth and pleasing outer appearance. Lastly, in the present embodiment, decorative layers 32 and 33 are positioned adjacent the diffuser layers 29 and 30, respectively. While the decorative layers may comprise a layer of paint, applied directly to the diffuser layers 29 and 30, in the present embodiment the decorative layers 32 and 33 comprise a decorative fabric, such as a fibrous glass fabric. It has been found that the outer decorative fabric layers 32 and 33 give the acoustical panel assembly 10 an outward furniture-like appearance which is pleasing, as opposed to many prior art wall partitions.

As shown in FIGS. 2 and 4, the decorative layers 32 and 33 are secured to the frame members 17–20. The free edges of the decorative fabric layers 32 and 33 are inserted into frame grooves, for example, the upper groove 23 of the top member 20. A plastic spline strip 34 having a diameter between .100 inch and .150 inch, depending on the type of fabric, is then inserted in the grooves, including the upper groove 23, to hold the decorative fabric layers 32 and 33 in place. It has been found that the use of the spline-groove combination results in a pleasing appearance along the edges of the acoustical panel assemblies 11, 12 and 13.

After the decorative layers 32 and 33 are installed, the bottom frame member 17 is positioned in a groove 36 defined by a base member 37. The base member 37 serves as a kick plate and is attached by screws or other fasteners to the bottom frame member 17 of the wall frame 16.

Figure 3:
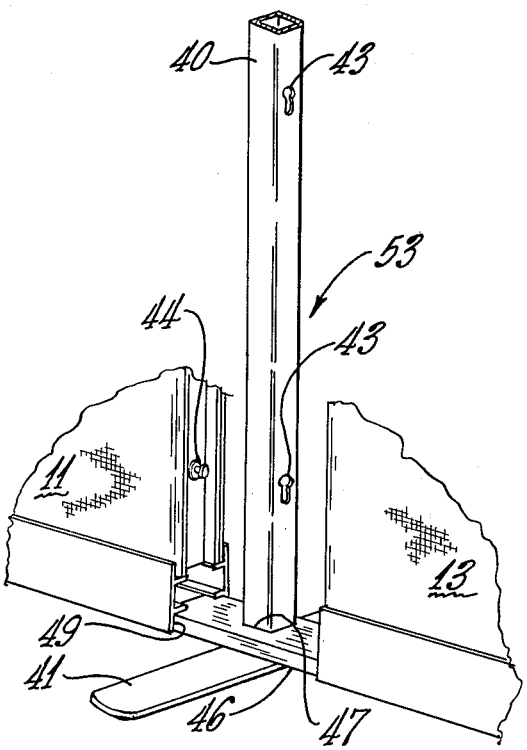
FIG. 3 is a diagrammatic perspective view, showing the panel assembly joining means, according to the present invention.

Joining means are provided for removably connecting the center acoustical panel assembly 11 to its adjacent end acoustical panel assemblies 12 and 13. In the present embodiment, the joining means include a vertical post 40 having a foot member 41 connected at its bottom. The foot member 41 extends outwardly in both directions from the post 40 and supports the entire acoustical panel assembly 10, as shown in FIG. 1. The vertical post 40 defines two or more vertically spaced keyhole slots 43 which receive shouldered screws 44 which are vertically spaced (see FIG. 3) along the outer edges of the side frame members 18 and 19. When the screws 44 are positioned in the keyhole slots 43, the individual panel assemblies 11, 12 and 13 assume the position shown in FIG. 1.

In the present embodiment, an alignment plate 46, which is generally U-shaped, defines a central opening 47. The opening 47 receives the vertical post 40. The base member or kick plate member 37 defines a bottom recess 49 (see FIG. 4) which receives the alignment plate 46. The alignment plate 46 not only aligns the adjacent panel assemblies 11, 12 and 13, but also gives structural integrity to the overall partition wall assembly.

Figure 6:
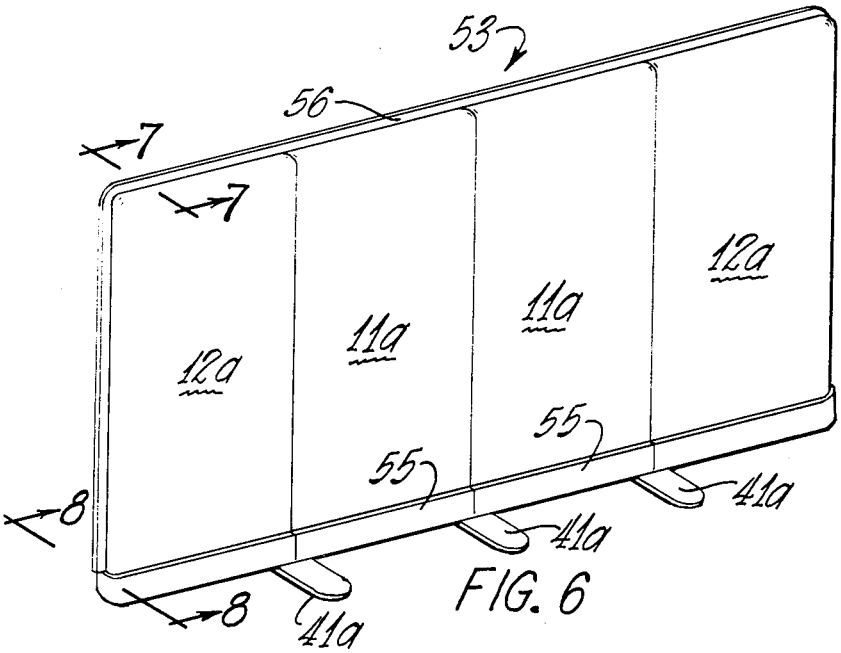
FIG. 6 is a perspective view of another embodiment of acoustical panel assemblies, according to the present invention.
Figure 7:
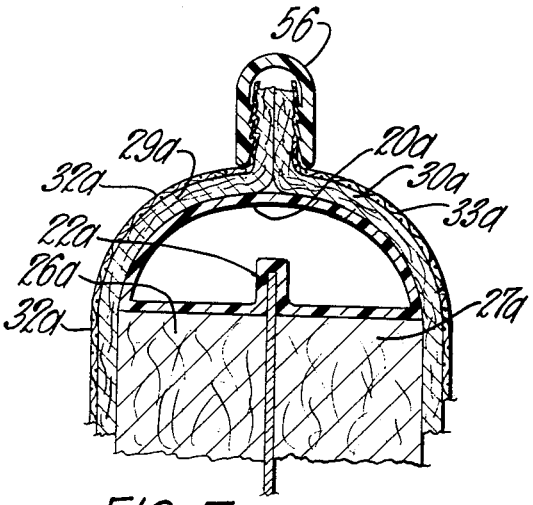
FIG. 7 is a fragmentary, enlarged sectional view, taken along the line 7—7 of FIG. 6.
Figure 8:
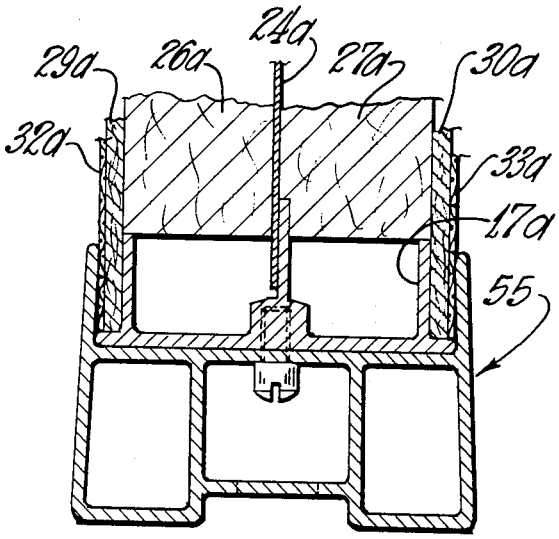
FIG. 8 is a fragmentary, enlarged sectional view, taken along the line 8—8 of FIG. 6.

Referring to FIGS. 6, 7 and 8, another embodiment of the present invention is shown. A wall partition 53 includes two center acoustical panel assemblies 11a and two end acoustical panel assemblies **12*a***.

Similarly, extruded frame members, for example a bottom frame member **17*a*, mount a base member 55 having a different configuration than the base member 37. This embodiment also includes a thin-wall septum member 24*a*, fibrous glass layers 26*a* and 27*a*, molded diffuser layers 29*a* and 30*a* and outer decorative layers 32*a* and 33*a*. However, in this embodiment, rather than using the spline assembly to connect the free edges of the decorative fabric layers 32*a* and 33*a* a U-shaped cap 56, constructed of a flexible resilient material, for example vinyl, of a color complementary with the decorative layers 32*a* and 33*a* receives the upper edges or side edges of the molded diffuser layers 29*a* and 30*a* and the decorative fabric layers 32*a* and 33*a*. The U-shaped cap 56** provides a decorative finish to the free edges of the assembly.

It has been found that acoustical panel assemblies, according to the present invention, provide a sound and decorative screen having acoustical properties which makes the structure effective for use in open areas. In addition, its attractive modular design allows a variety of arrangments for creating efficient work spaces.

What I claim is:

1. An acoustical panel assembly comprising, in combination, a plurality of panels each including a septum member, a frame surrounding said septum member, a pair of fibrous glass layers positioned respectively adjacent opposite sides of said septum member, and a pair of semi-rigid fibrous glass diffuser members positioned respectively adjacent said fibrous glass layers, and means for joining adjacent ones of said panels.

2. An acoustical panel assembly, according to claim 1, wherein said septum member comprises a thin sheet of metal.

3. An acoustical panel assembly, according to claim 1, wherein each of said fibrous glass layers has a thickness of between one-half inch and two inches.

4. An acoustical panel assembly, according to claim 1, wherein each of said fibrous glass diffuser members comprises a molded semi-rigid member.

5. An acoustical panel assembly, according to claim 1, wherein said frame includes at least one frame side member and wherein said joining means includes a post and foot assembly, said post being positioned adjacent said frame side member, and attaching means on said post and said frame side member for removably mounting said frame to said post.

6. An acoustical panel assembly, according to claim 5, wherein said attaching means comprises at least two shoulder screws on one of said post and frame side members and complementary keyhole slots defined by the other of said post and frame side members.

7. An acoustical panel assembly, according to claim 5, wherein said frame includes a frame bottom member, a kick plate member attached to said frame bottom member, said kick plate member defining a bottom recess, and an alignment plate positioned in such bottom recess, said alignment plate defining an opening, said post extending through such opening.

8. An acoustical panel assembly, according to claim 5, wherein said frame includes two frame side members, a frame top member and a frame bottom member, a kick plate member connected to said frame bottom member, a pair of outer fabric layers positioned respectively adjacent said fibrous glass diffuser members, and means for securing said fabric layers adjacent said frame members.

9. An acoustical panel assembly, according to claim 8, wherein said frame top member defines a narrow slot along its upper surface, said fabric layers having their upper edges positioned within said slot, said securing means including a spline member positioned within said slot to frictionally hold the upper edges of the fabric layers in place.

10. An acoustical panel assembly, according to claim 8, wherein said securing means includes a top cap member which engages and holds the upper edges of said fabric layers.

11. An acoustical panel assembly comprising, in combination, a plurality of panels each including a perimeter frame having a top frame member, a bottom frame member, and two opposed side frame members, a septum member received by said perimeter frame, said septum member comprising a thin metal sheet, a pair of fibrous glass layers positioned respectively adjacent opposite sides of said septum member, and a pair of semi-rigid fibrous glass diffuser members positioned respectively adjacent said fibrous glass layers, and means for joining adjacent ones of said panels.

12. An acoustical panel assembly, according to claim 11, wherein said joining means includes a vertical post having a foot support plate connected adjacent the bottom of said post, said vertical post being positioned adjacent one of said side frame members and attaching means on said post and said frame side member for removably mounting said frame to said post.

13. An acoustical panel assembly, according to claim 12, including a pair of outer fabric layers positioned respectively adjacent said fibrous glass diffuser members.

14. An acoustical panel assembly, according to claim 13, wherein said fibrous glass layers have a density between 3 and 8 pounds per cubic foot.

15. An acoustical panel assembly, according to claim 14, wherein each of said fibrous glass diffuser members comprises a molded fibrous glass board having a density between 12 and 25 pounds per cubic foot.

16. An acoustical panel comprising a septum, a frame surrounding the septum, a pair of fibrous glass layers positioned respectively adjacent opposite sides of the septum, and a pair of semi-rigid fibrous glass diffuser members positioned respectively adjacent the fibrous glass layers.

17. An acoustical panel as claimed in claim 16, wherein the septum comprises a thin sheet of metal.

18. An acoustical panel as claimed in claim 16, wherein each of the fibrous glass layers has a thickness of between one-half inch and 2 inches.

19. An acoustical panel as claimed in claim 16, wherein each of the fibrous glass diffuser members comprises a molded semi-rigid member.

20. An acoustical panel as claimed in claim 16, wherein the frame includes two side frame members, a top frame member, and a bottom frame member, and including a kick plate member connected to the bottom frame member, a pair of outer fabric layers positioned respectively adjacent the fibrous glass diffuser members, and means for securing the fabric layers adjacent the frame members.

21. An acoustical panel as claimed in claim 20, wherein the top frame member defines a narrow slot along its upper surface, the fabric layers having their upper edges positioned within the slot and the securing means including a spline member positioned within the slot and frictionally holding the upper edges of the fabric layers in place.

* * * * *